US007329147B2

(12) United States Patent
Wang

(10) Patent No.: US 7,329,147 B2
(45) Date of Patent: Feb. 12, 2008

(54) ELECTRICAL CONNECTOR WITH A SPACER WITH REVERSE U-SHAPED SLOTS

(75) Inventor: Zhen-Sheng Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/591,369

(22) Filed: Oct. 31, 2006

(65) Prior Publication Data

US 2007/0099515 A1 May 3, 2007

(30) Foreign Application Priority Data

Oct. 31, 2005 (CN) ..... 200520076968

(51) Int. Cl.
*H01R 13/73* (2006.01)

(52) U.S. Cl. ..... 439/571

(58) Field of Classification Search ..... 439/571, 439/572, 607, 567, 79, 609, 358
See application file for complete search history.

(56) References Cited

U.S. PATENT DOCUMENTS

| | | | | |
|---|---|---|---|---|
| 6,210,218 | B1 * | 4/2001 | Chang | 439/567 |
| 6,685,486 | B1 * | 2/2004 | Zhang et al. | 439/79 |
| 6,736,676 | B2 * | 5/2004 | Zhang et al. | 439/607 |
| 2004/0058583 | A1 * | 3/2004 | Zhang et al. | 439/607 |

* cited by examiner

*Primary Examiner*—Chandrika Prasad
(74) *Attorney, Agent, or Firm*—Wei Te Chung

(57) ABSTRACT

An electrical connector includes an insulating housing, a plurality of contacts, a spacer and a shield. The insulating housing has a main body and a tongue extending from the main body. The main body has a room receiving the spacer. Each contact has a contact portion and an inverse U-shaped hold portion extending from the contact portion. A plurality of passageways and recesses are formed on the spacer for receiving the inverse U-shaped hold portions of the contacts.

20 Claims, 6 Drawing Sheets

ELECTRICAL CONNECTOR WITH A SPACER WITH REVERSE U-SHAPED SLOTS

BACKGROUND OF THE INVENTION

1. Field of the Invention

The present invention relates to an electrical connector, and more particularly to an electrical connector mounted on a print circuit board.

2. Description of Related Art

An electrical connector mounted on a print circuit board usually includes an insulating housing and a plurality of contacts received in the insulating housing. Each of the contacts has a tail portion extending out of the insulating housing and soldered on the print circuit board by SMT or Through-hole. In order to assemble the contacts on corresponding pads or into corresponding holes on the print circuit board accurately, the electrical connector usually further includes a spacer for receiving the tail portions of the contacts. U.S. Pat. No. 6,099,351 discloses an electrical connector mounted on a print circuit board. The electrical connector comprises a housing with a tongue platform, a number of contacts, a spacer defining some cavities for retaining the contacts and inserted into the housing and a pair of grounding shields covering the housing. Each contact has a horizontal mating portion lying on a side of the tongue platform and a mounting portion for being mounted on the print circuit board. The contacts are downwardly bent approximately 90 degrees from the mating portions for being securely inserted into and retained in the cavities of the spacer. The spacer can prevent the contacts from wobbling or being curved so that the mounting portions can insert into corresponding holes on the print circuit board, easily and accurately.

However, the spacer cannot be adapted for some other electrical connectors, especially for an electrical connector, whose contacts having complicated structure. For example, a contact has an inverse U-shaped portion extending from a mating portion. The spacer disclosed in U.S. Pat. No. 6,099,351 is unable to receive such a contact with an inverse U-shaped portion. It is necessary to develop a new type spacer to overcome the problems.

SUMMARY OF THE INVENTION

The object of the present invention is to provide an electrical connector, which has a spacer for receiving contacts.

In order to achieve above-mentioned object, an electrical connector is provided which comprises an insulating housing defining a room at an end thereof; a plurality of contacts, each contact having a contact portion, an inverse U-shaped hold portion extending from the contact portion and comprising two opposed legs, a free end of the leg far away the contact portion extending downwardly for mounting on a print circuit board; and a spacer received in the room of the insulating housing comprising a plurality of passageways running through the spacer in a top-to-bottom direction on a rear end of the spacer and a plurality of recesses recessed from an outer surface of the spacer, each passageway and a corresponding recess receiving the opposed legs of the inverse U-shaped hold portion of one corresponding contact, respectively. In assembly, the recesses and the passageways formed on the spacer for receiving the inverse U-shaped hold portions can reduce the resistance on the contact portions when the contacts are assembled into the insulating housing. As a result, the contacts will avoid being broken easily. It also brings a better fixation between the contacts and the spacer.

Other objects, advantages and novel features of the present invention will become more apparent from the following detailed description of the present embodiment when taken in conjunction with the accompanying drawings.

DETAILED DESCRIPTION OF THE INVENTION

Figure 1:
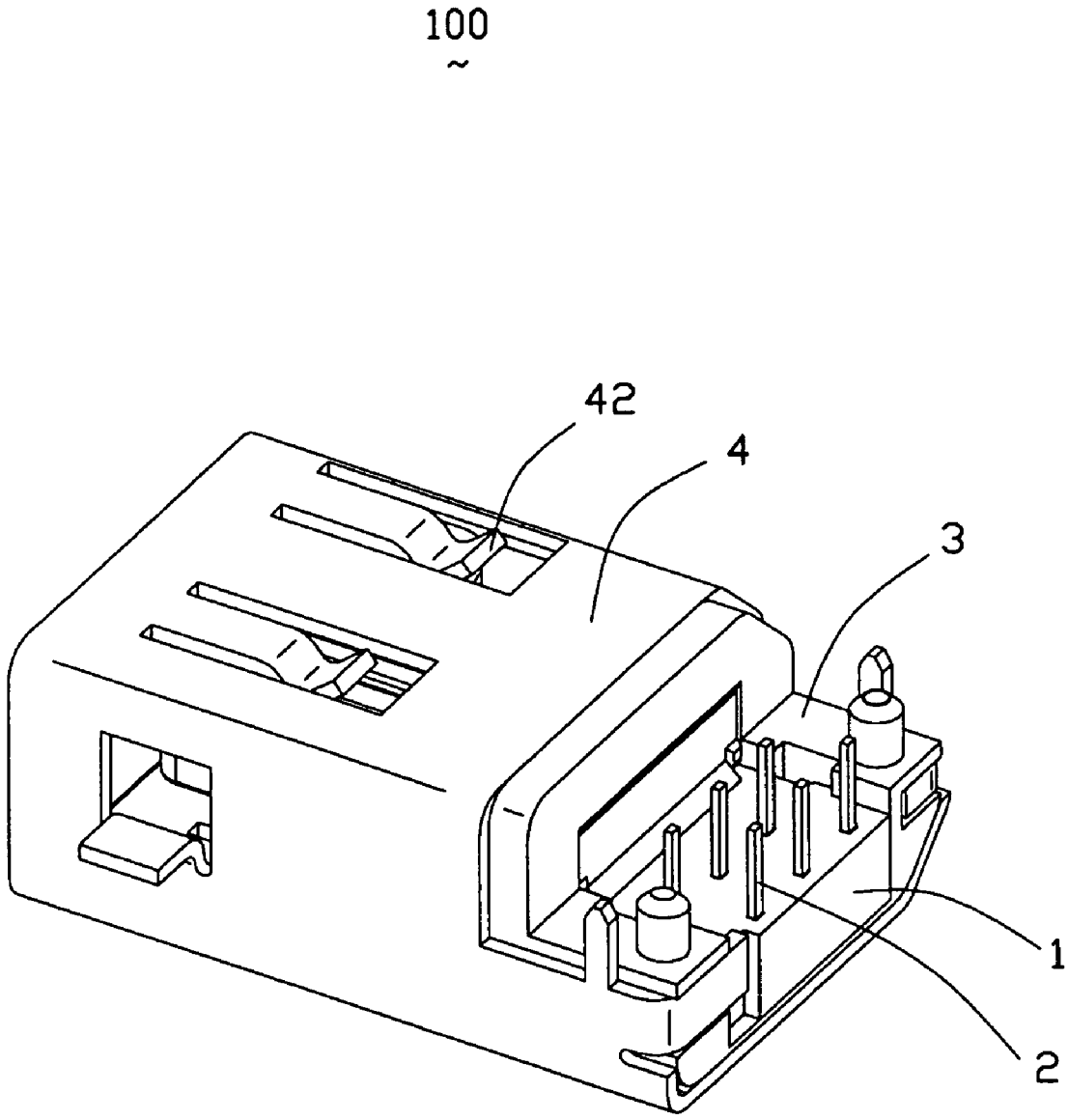
FIG. 1 is an assembled, perspective view of the electrical connector taken from a bottom face in accordance with the present invention.

Referring to FIG. 1, an electrical connector 100 in accordance with the present invention is provided. The electrical connector 100 comprises a plurality of contacts 2, an insulating housing 3 receiving the contacts 2, a spacer 1 and a shield 4 covering over the insulating housing 3.

Figure 2:
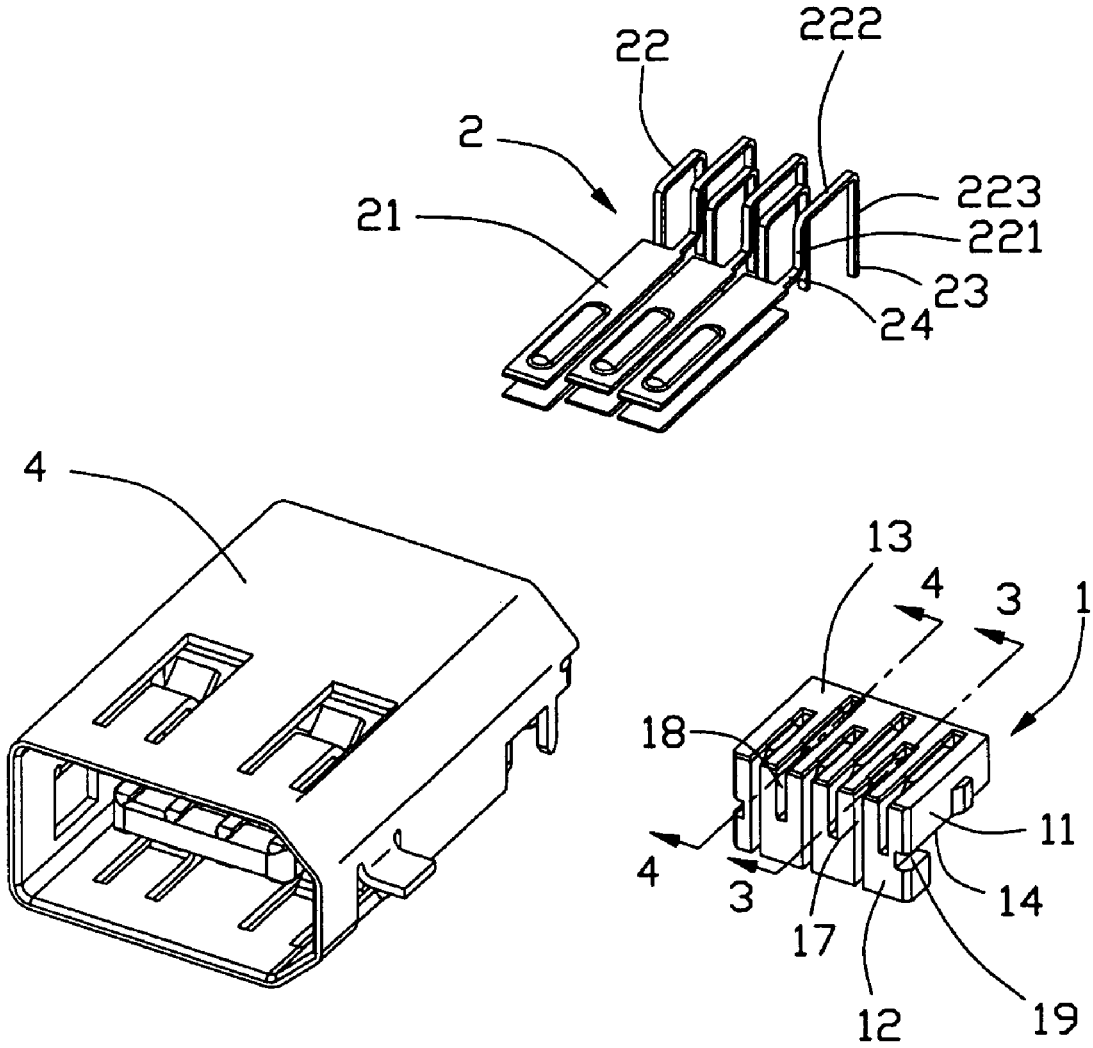
FIG. 2 is a partially exploded, perspective view of the electrical connector.

Referring to FIG. 2, each of the contacts 2 comprises a contact portion 21, an inverse U-shaped hold portion 22 and a linking portion 24 linking the U-shaped hold portion 22 and the contact portion 21. The contact portion 21 is a long and narrow horizontal plate. The contact 2 is bent from an end of the linking portion 24 upwardly and vertically to form a first vertical portion 221. A horizontal portion 222 is formed by bending the first vertical portion 221 vertically. A second vertical portion 223 is bent from the horizontal portion 222 downwardly and vertically. The first vertical portion 221, horizontal portion 222 and second vertical portion 223 form the inverse U-shaped hold portion 22 together. The first vertical portion 221, horizontal portion 222 and second vertical portion 223 are all retained in the spacer 1. The first vertical portion 221 and the second vertical portion 223 are two opposed legs of the U-shaped hold portion 22. The second vertical portion 223 is much farther away from the contact portion 21 than the first vertical portion 221 of the contact 2. A free end 23 of the second vertical portion 223 is used for contacting with the print circuit board. The dimension of the contact portion 21 is larger than that of the inverse U-shaped hold portion 22 in width. The contacts 2 are divided into an upside row and a downside row with a similar structure. Each linking portion 24 of the contacts 2 in upside row extends from a right side of corresponding contact portion 21, while each linking portion 24 of the contact 2 in downside row extends from a left side of corresponding contact portion 21, by this way, the contact portions 21 of the contacts 2 in upside row and in downside row are arranged in pairs in vertical direction while the inverse U-shaped hold portions 22 are interlaced.

The contact portion 21 and the U-shaped hold portion 22 of each contact are similar with each other contact. The linking portions 24 of the contacts 2 in upside row are longer than that of the contacts 2 in downside row, which causes the U-shaped hold portions 22 interlaced in a front-to-back direction.

Figure 3:
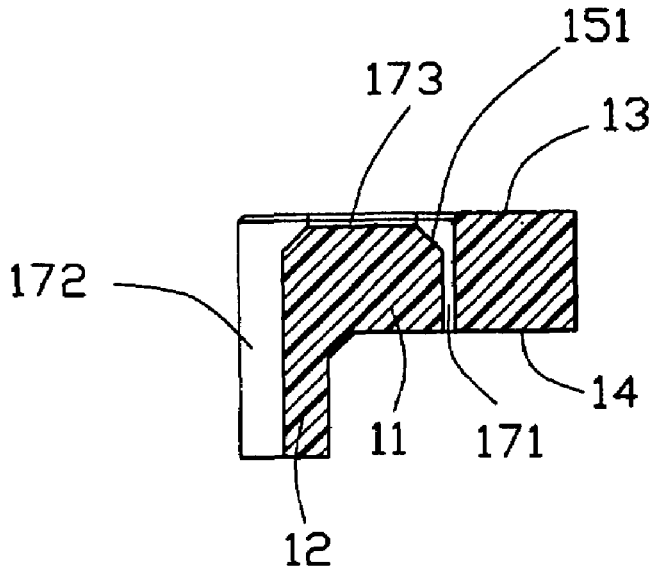
FIG. 3 is a cross-section view of the spacer of the electrical connector taken along line 3-3 of FIG. 2.
Figure 5:
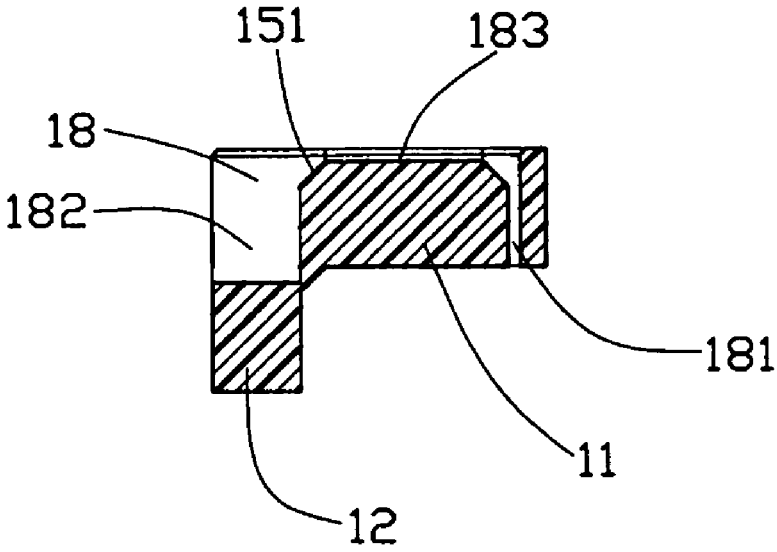
FIG. 5 is a cross-section view of the spacer of the electrical connector taken along line 4-4 of FIG. 2.

The spacer 1 configured in an L-shape includes a rectangular base 11 and an extending portion 12 extending downwardly and vertically from the rectangular base 11. The spacer 1 comprises a top surface 13 and a bottom surface 14 defining a plurality of interlaced slots 17, 18. The inverse U-shaped hold portions 22 of the contacts 2 are received in the slots 17, 18. Referring to FIG. 3, each slot 17 comprises a passageway 171 running through the top surface 13 and the bottom surface 14 of the spacer 1, a recess 172 parallel to the passageway 171 recessed from a front outer surface (not labeled) of the spacer 1 and running through the spacer 1 and a horizontal groove 173 recessed from the top surface 13 and linking the passageway 171 and recess 172. Each horizontal groove 173 has two slant surfaces 151 at the joint linking with corresponding passageway 171 and recess 172. As shown in FIG. 5, each slot 18 is configured in a similar structure with each slot 17 and includes a passageway 181, a recess 182 and a horizontal groove 183 with two slant surfaces 151. The differences between the slot 17 and slot 18 are that the passageway 181 is set much closer to the rear end of the base 11 than passageway 171, and the recess 182 has a father distance recessed from the front outer surface (not labeled) of the spacer 1 than that of the recess 172, moreover, the recess 182 does not run through the spacer 1.

Figure 4:
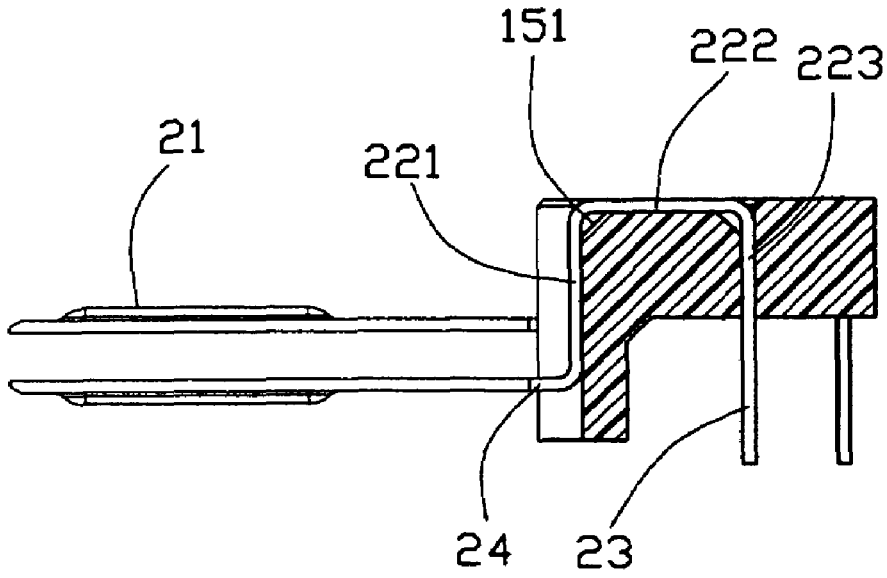
FIG. 4 is a cross-section view similar to FIG. 3, wherein a plurality of contacts inserted into the spacer.
Figure 6:
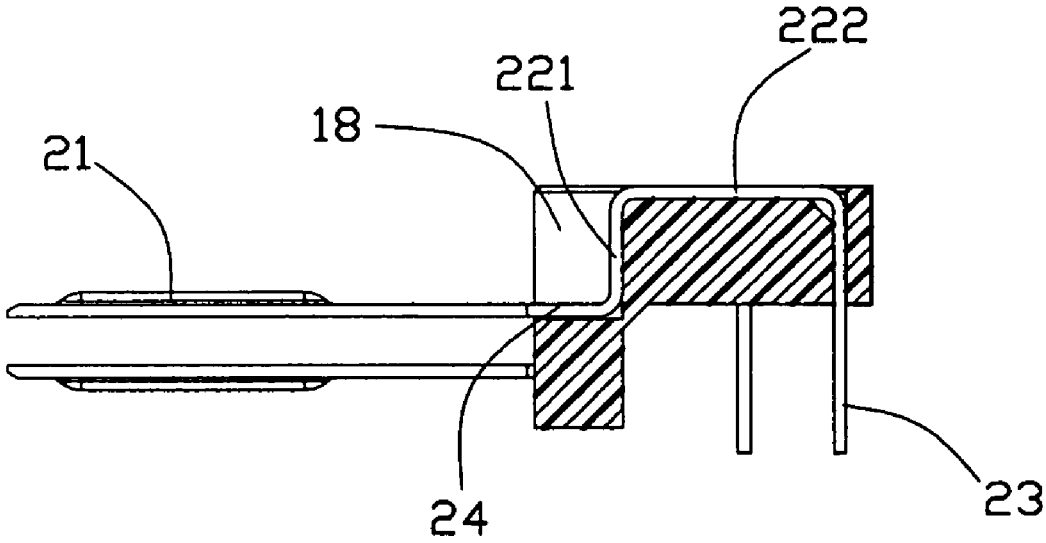
FIG. 6 is a cross-section view similar to FIG. 5, wherein the contacts inserted into the spacer.

As shown in FIGS. 2, 4, 6, the contacts 2 are assembled into the spacer 1 from the top of the spacer 1 so that the inverse U-shaped hold portions 22 are received in the slots 17, 18. The first vertical portions 221 are received in the recesses 172, 182. The horizontal portions 222 are received in the horizontal grooves 173, 183 while the second vertical portions 223 are received in the passageways 171, 181. And the free ends 23 of the second vertical portions 223 extend out of the passageways 171, 181 to contact with the print circuit board. The contact portions 21 of the contacts 2 are protruding from the spacer 1. The horizontal portions 222 have a same dimension with the horizontal grooves 173, 183 in length. The first vertical portions 221 abut an inner side surface of the recesses 172, 182. The slant surfaces 151 are configured to couple with the corresponding corners which connect the vertical portions 221, 223 with the horizontal portions 222 of the contacts 2, so that the contacts 2 will not be broken easily. As shown in FIGS. 4, 6, the contacts 2 in upside row and downside row are respectively received in the interlaced slots 17 and the slots 18.

Figure 7:
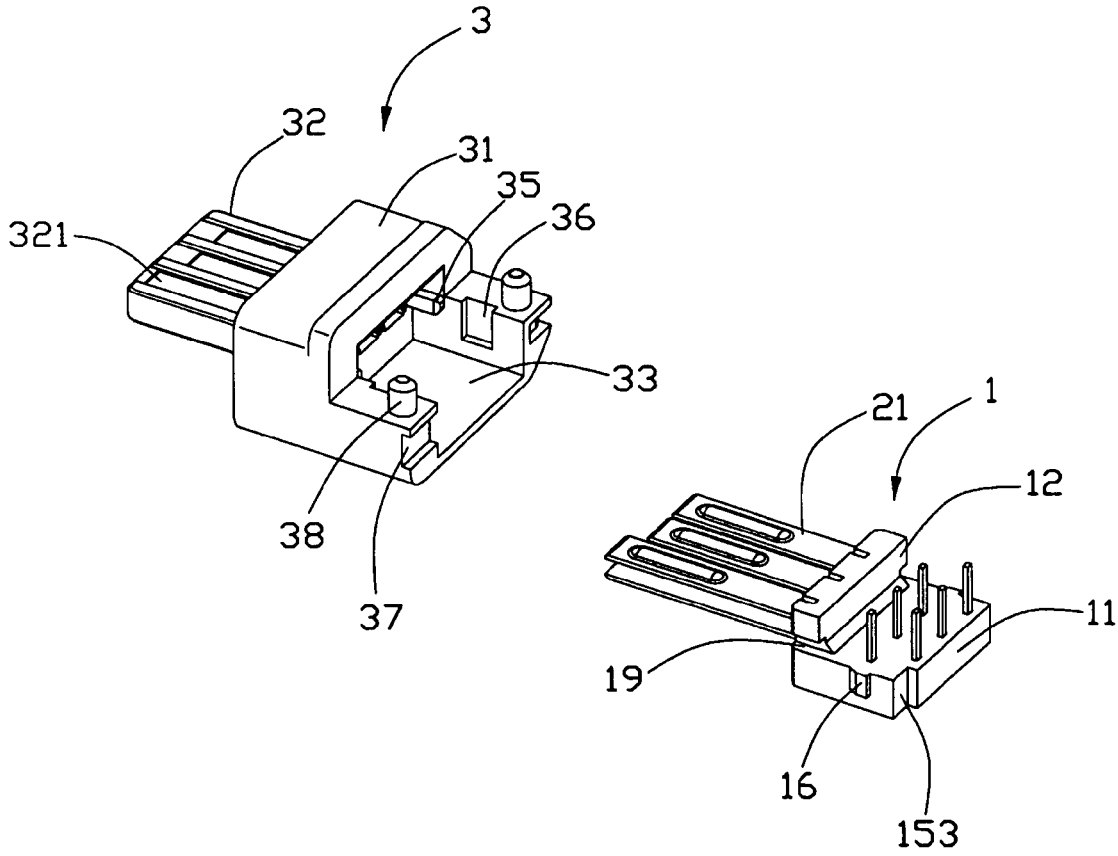
FIG. 7 is a partially exploded, perspective view of an insulating housing and the spacer with the contacts.

FIG. 7 is a view of the insulating housing 3 taken from a bottom surface. The insulating housing 3 includes a main body 31 and a tongue 32 extending from the main body 31 for engaging with a complementary connector (not shown). The main body 31 has a room 33 for receiving the spacer 1 on the rear end thereof. A pair of notches 36 and a pair of sticks 35 adjacent to the notches 36 are formed respectively on sidewalls of the room 33. The main body 31 has a pair of concaves 37 recessed from a rear end surface thereof. A bottom surface of the main body 31 has a pair of posts 38. A plurality of channels 321 are formed on the top and bottom surfaces of the tongue 32 and communicate with the room 33 for receiving the contact portions 21 of contacts 2.

The spacer 1 receiving the contacts 2 is inserted into the room 32 of the insulating housing 3 from back to front. The contact portions 21 are secured in the channels 321 on the tongue 32. A pair of extrudes 16 and locking slots 19 are formed on two side surfaces of the spacer 1. The spacer 1 is retained in the insulating housing 3 by coupling the extrudes 16 with the notches 36 and the locking slots 19 with the sticks 35. When assembly, the contact portions 21 of the contacts 2 may not be in an accurate position in the channels 321 or may suffer from some external force, under such situation, the inverse U-shaped hold portions 22 of the contacts 2, especially the first vertical portions 221, will make the contact portions 21 be retained reliably. And the slots 17, 18 will prevent the first vertical portions 221 from swinging and being curved.

Figure 8:
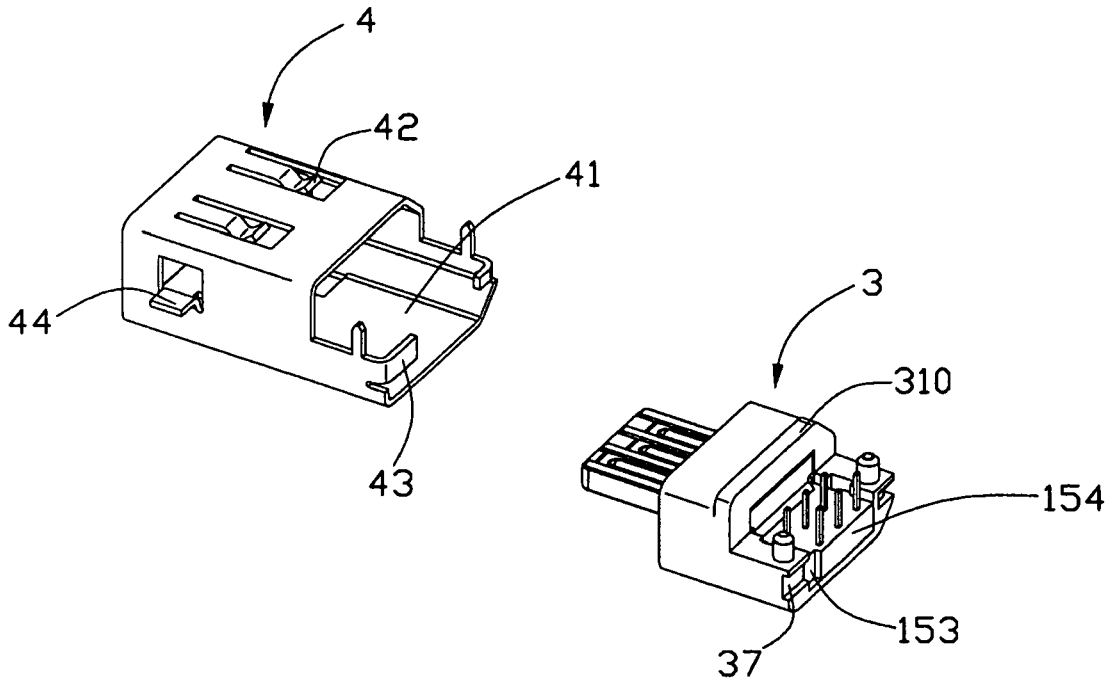
FIG. 8 is another partially exploded, perspective view of the electrical connector.

As shown in FIG. 8, the shield 4 is made of metal piece and forms a cavity 41 for receiving the insulating housing 3 and a pair of metal arms 43 on opposed sidewalls thereof. The spacer 1 has a groove 153 aligned with a corresponding concave 37 on a rear end surface 154 thereof. After the insulating housing 3 is assembled into the shield 4, the metal arms 43 are bent inwardly to abut against into the concaves 37 and groove 153. As shown in FIG. 1, the shield 4 has a plurality of spring plates 42 extending inwardly from a top wall and a bottom wall. The shield 4 has a pair of soldering portions 44 extending horizontally and outwardly from two sidewalls thereof for being soldered on the print circuit board.

However, it is to be understood that the present invention is not limited to the embodiment and various modifications can be made without departing from the subject matter of the present invention. For example, the hold portion of the contacts is not limited to be configured in an inverse U-shape, an U-shaped hold portion can also be used in the present invention. And the L-shaped spacer also can be replaced with a rectangular spacer without any extending portion. The slots can be also formed in U-shape to couple with the corresponding U-shaped hold portion.

What is claimed is:

1. An electrical connector comprising:

an insulating housing defining a room at an end thereof;

a plurality of contacts, each contact having a contact portion, an inverse U-shaped hold portion extending from the contact portion and comprising two opposed legs; and a spacer received in said room of the insulating housing comprising a plurality of passageways running through the spacer in a top-to-bottom direction on a rear end of the spacer and a plurality of recesses recessed from a front surface of the spacer, each passageway and a corresponding recess receiving the opposed legs of the inverse U-shaped hold portion of one corresponding contact.

2. The electrical connector as claimed in claim 1, wherein said spacer further including a horizontal groove connecting said passageway and said recess, each inverse U-shaped hold portion of the contact further having a horizontal portion received in said horizontal groove.

3. The electrical connector as claimed in claim 2, wherein a free end of said leg far away the contact portion of the contact extends downwardly for mounting on a print circuit board.

4. The electrical connector as claimed in claim 2, wherein said horizontal groove defining two corners with a pair of slant surfaces connecting with said passageway and recess.

5. The electrical connector as claimed in claim 1, wherein said spacer formed in a L-shape including a base and an extending portion protruding vertically and downwardly from one end of the base.

6. The electrical connector as claimed in claim 5, wherein a pair of extrudes and locking slots are formed on two side surfaces of the spacer for coupling with a pair of notches and sticks formed on the insulating housing.

7. The electrical connector as claimed in claim 5, further includes a shield covering the insulating housing and having a pair of metal arms on a rear end of the shield, a groove is recessed from a rear end surface of the spacer, the metal arms is extending inwardly to abut against with the groove.

8. The electrical connector as claimed in claim 7, wherein said insulating housing has a concave on the rear end surface thereof, the concave aligns with said groove of the spacer and engages with said metal arm of the shield.

9. The electrical connector as claimed in claim 8, wherein said insulating housing has a main body and a tongue extending from the main body, a plurality of channels are formed on the upside surface and downside surface of said tongue and communicate with the room of the insulating housing.

10. The electrical connector as claimed in claim 9, wherein said contacts are divided into an upside row and a downside row, the contact portions are wider than the inverse U-shaped hold portions, the inverse U-shaped hold portion of each contact in the upside row extends from a right side of corresponding contact portion while the inverse U-shaped hold portion of each contact in the downside row extends from the left side of the corresponding contact portion.

11. An electrical connector comprising:

an insulating housing defining a mating tongue in a front portion and a spacer receiving region in a rear portion;

a plurality of channels formed in at one face of the mating tongue;

a spacer positioned in the spacer receiving region;

a plurality of juxtaposed slots disposed in the spacer, each of said slots defining a front section, a rear section and a middle section connecting the front section and the rear section and exposed on a top face of the spacer; and a plurality of contacts, each contact having a horizontal contact portion, a generally inverse U-like holding portion located behind the contact portion; wherein the contact portion is received in the corresponding channel, and the inverse holding portion is received in the corresponding slot under a condition that the contact portion is horizontally assembled into the corresponding channel while the inverse U-shaped holding portion is vertically assembled to the corresponding slot.

12. The connector as claimed in claim 11, wherein a supporting step is formed in a front section of the spacer so as to support a linking portion between the contact portion and the inverse holding portion.

13. The connector as claimed in claim 11, wherein the front section and a rear section of the spacer are vertical while a middle section of the spacer is horizontal.

14. The connector as claimed in claim 11, wherein the housing defines a board mounting surface which is generally at a middle level of the housing, and the spacer defines a bottom face, through which a tail of the contact extends downwardly, being located around said middle level.

15. The connector as claimed in claim 11, wherein said spacer is configured to be of an L-shape in a side view, including a vertical portion and a horizontal portion under a condition that the front section of the slot is formed in the vertical portion and the rear section of the slot is formed in the horizontal portion.

16. An electrical connector comprising:

an insulating housing defining a mating region in a front portion and a spacer receiving region in a rear portion;

a spacer positioned in the spacer receiving region;

a plurality of juxtaposed slots disposed in the spacer, each of said slots defining a front section, a rear section and a middle section connecting the front section and the rear section and exposed on a top face of the spacer; and a plurality of contacts, each contact having a horizontal contact portion, a at least three-segment holding portion located behind the contact portion; wherein the contact portion is received in the corresponding channel, and the holding portion is received in the corresponding slot under a condition that the contact portion is horizontally assembled into the corresponding channel while the three-segment holding portion is vertically assembled to the corresponding slot.

17. The connector as claimed in claim 16, wherein a supporting step is formed in a front vertical section of the spacer so as to support a linking portion between the contact portion and the holding portion.

18. The connector as claimed in claim 16, wherein the front section and the rear section are vertical while the middle section is horizontal.

19. The connector as claimed in claim 16, wherein the housing defines a board mounting surface which is generally at a middle level of the housing, and the spacer defines a bottom face, through which a tail of the contact extends downwardly, being located around said middle level.

20. The connector as claimed in claim 16, wherein said spacer is configured to be of an L-shape in a side view, including a vertical portion and a horizontal portion under a condition that the front section of the slot is formed in the vertical portion and the rear section of the slot is formed in the horizontal portion.

* * * * *